US005873180A

United States Patent [19]

Grunder

[11] Patent Number: 5,873,180

[45] Date of Patent: Feb. 23, 1999

[54] PAPERMAKING DRYER SECTION WITH PARTITIONED VACUUM BOX FOR THREADING

[75] Inventor: Thomas K. Grunder, Beloit, Wis.

[73] Assignee: Beloit Technologies, Inc., Wilmington, Del.

[21] Appl. No.: 719,498

[22] Filed: Sep. 25, 1996

[51] Int. Cl.[6] ..... F26B 11/02

[52] U.S. Cl. ..... 34/117; 34/458

[58] Field of Search ..... 34/114, 117, 120, 34/115, 444, 453, 458

[56] References Cited

U.S. PATENT DOCUMENTS

| | | | |
|---|---|---|---|
| 4,502,231 | 3/1985 | Fissmann et al. | 34/114 |
| 4,686,778 | 8/1987 | Kotitschke et al. | 34/117 |
| 4,876,803 | 10/1989 | Wedel | 34/117 |
| 4,932,138 | 6/1990 | Liedes et al. | 34/120 |
| 4,980,979 | 1/1991 | Wedel | 34/120 |
| 5,015,336 | 5/1991 | Roerig et al. | 162/369 |
| 5,019,213 | 5/1991 | Virta et al. | 162/193 |
| 5,065,529 | 11/1991 | Skaugen et al. | 34/117 |
| 5,068,980 | 12/1991 | Muller | 34/117 |
| 5,152,078 | 10/1992 | Wedel | 34/115 |
| 5,337,490 | 8/1994 | Griffin et al. | 34/117 |
| 5,404,653 | 4/1995 | Skaugen et al. | 34/117 |
| 5,465,502 | 11/1995 | Holik et al. | 34/115 |
| 5,515,619 | 5/1996 | Kahl et al. | 34/114 |
| 5,600,897 | 2/1997 | Sollinger et al. | 34/115 |

*Primary Examiner*—William Doerrler
*Attorney, Agent, or Firm*—Lathrop & Clark LLP

[57] ABSTRACT

A single tier dryer system has dryer rolls with a reversing roll positioned between each pair to transfer and wrap the dryer felt and paper web against the next dryer roll. A vacuum box is positioned between the dryer rolls and over the reversing roll to hold the web on the dryer felt by vacuum. Threading of a tail from the web is accomplished by blowing the web tail off a first dryer roll's surface with a jet of air positioned adjacent to the position on the dryer roll where the dryer felt leaves the dryer roll's surface. The vacuum box is divided by a baffle to isolate a portion of the vacuum box near the front of the dryer rolls, and a damper is positioned within the reversing roll to increase the vacuum in the isolated portion of the vacuum box to facilitate threading of the tail.

19 Claims, 2 Drawing Sheets

PAPERMAKING DRYER SECTION WITH PARTITIONED VACUUM BOX FOR THREADING

FIELD OF THE INVENTION

The present invention relates to apparatus for threading a paper web through a papermaking machine. More particularly, the present invention relates to apparatus for threading a paper web through the dryer section of a papermaking machine.

BACKGROUND OF THE INVENTION

Paper is manufactured in a continuous process starting with a papermaking stock consisting of fibers suspended in water. A web of fibers is formed by depositing fibers from the stock onto one or more forming wires in the forming section or wet end of a papermaking machine. The web leaves the former with a fiber content of ten to twenty percent and enters a pressing section where the fiber content is increased to thirty-five to fifty percent. From the pressing section the paper web enters a dryer section where the web is dried to ninety-five percent fiber and five percent moisture. Although paper making is a continue process, it must be started each time a new grade of paper is made or the web being formed breaks. Web breaks can be frequent, especially during initial setup of a new or modified papermaking machine.

The process of starting a papermaking machine is called threading the machine. As the web progresses through the former and the pressing section it is generally supported at all times by a forming wire or press felt. Thus the forming section and the press section generally thread automatically. Historically, threading the dryer section has been more problematic. In most existing papermaking machines two ropes are run side by side in a groove on the front face of the dryer section. The web is cut either at the former or in the press section to form a tail about four to twelve inches wide and the rest of the web is discarded and reprocessed into fiber. The tail is separated from the rest of the web at the end of the press section and the tail is blown onto the threading ropes which entangle the tail between the threading ropes and drag the tail through the dryers. When the tail successfully transits the dryer section the tail is gradually increased in width until the entire web passes through the dryer section and the threading operation is complete.

The use of ropes to effect threading of the dryer section has several disadvantages. First, as papermaking speeds have increased the reliability of the rope method of threading has decreased. In addition, the rope threading of the paper web offsets the tail to the outside of the dryers away from its normal path through the dryer section which can contribute to breakage of the tail as it is being threaded. At higher speeds the ropes can break and become entangled with components of the dryer section causing paper breaks and machine downtime. An improved approach to threading has been provided by using a damper within a reversing roll to selectively increase the vacuum drawn on that portion of the roll which contacts the tail during threading. Enclosed boxes have been inserted between two dryer rolls above the reversing roll, to allow a vacuum to be drawn between the box exterior walls and the moving felt. However, it would be desirable to more selectively apply the vacuum to the region of the tail during threading.

What is needed is an apparatus and method for threading the dryer section of a papermaking machine without the use of ropes.

SUMMARY OF THE INVENTION

The threading apparatus of this invention is employed with single tier dryer systems consisting of dryer rolls with a vacuum reversing roll disposed between each pair of dryer rolls. For a top felted top dryer section, a dryer felt holds the web to be dried against the surface of each dryer. The reversing roll serves to transfer and wrap the dryer felt and paper web from one dryer roll to the next. As the paper web and dryer felt wrap around the reversing roll, the dryer felt is positioned against the surface of the transfer roll and the paper web is not held between the felt and the reversing roll. In order to prevent the fluttering which can result as paper speeds increase, the reversing roll is normally a vacuum roll. Paper fluttering can result in wrinkling of the paper web and in paper breaks. The vacuum reversing roll clamps the web to the felt by drawing atmospheric air through the felt and thereby prevents fluttering. The clamping action of the reversing roll together with the clamping of the web between the dryer felt and the dryer rolls improves sheet formation by reducing cross machine shrinkage of the paper web.

To better hold the web on the felt as it moves between the dryer rolls a vacuum box is positioned between the dryer rolls and over the reversing roll so that as the web is transferred from the first dryer roll to the reversing roll and from the reversing roll to the second dryer roll it is held on the dryer felt by vacuum. The ends of the vacuum box are formed by sheet metal baffles or seals mounted to a cross machine beam, while the sides of the vacuum box are defined by the moving felt itself which is engaged against sealing members affixed to the metal baffles. The vacuum applied to the reversing roll is communicated through holes in the reversing roll to the vacuum box, and from the vacuum box through the dryer felt to the web.

In order to thread the dryer section the tail of the web must be led around the reversing rolls. This is accomplished by blowing the web off the first dryer roll surface with a jet of air positioned adjacent to the point on the dryer roll where the dryer felt leaves the dryer roll surface. In addition the vacuum box is divided by a threading baffle which isolates a portion of the vacuum box near the front of the dryer section. A damper is positioned inside the reversing roll which increases the vacuum in the isolated portion of the vacuum box. The combination of the air jet and threading vacuum applied at each dryer reversing roll assures that the tail of the threading web leaves each dryer in turn and is clamped by the higher vacuum of the threading chamber to the dryer felt as it turns around the reversing rolls between dryer rolls.

It is a feature of the present invention to provide a dryer section less prone to paper web breaks.

It is another feature of the present invention to provide a means for threading a dryer section of a papermaking machine which does not require ropes.

It is a further feature of the present invention to provide a dryer section of a papermaking machine which can operate cost-effectively at higher machine speeds.

Further objects, features and advantages of the invention will be apparent from the following detailed description when taken in conjunction with the accompanying drawings.

DESCRIPTION OF THE PREFERRED EMBODIMENT

Figure 1:
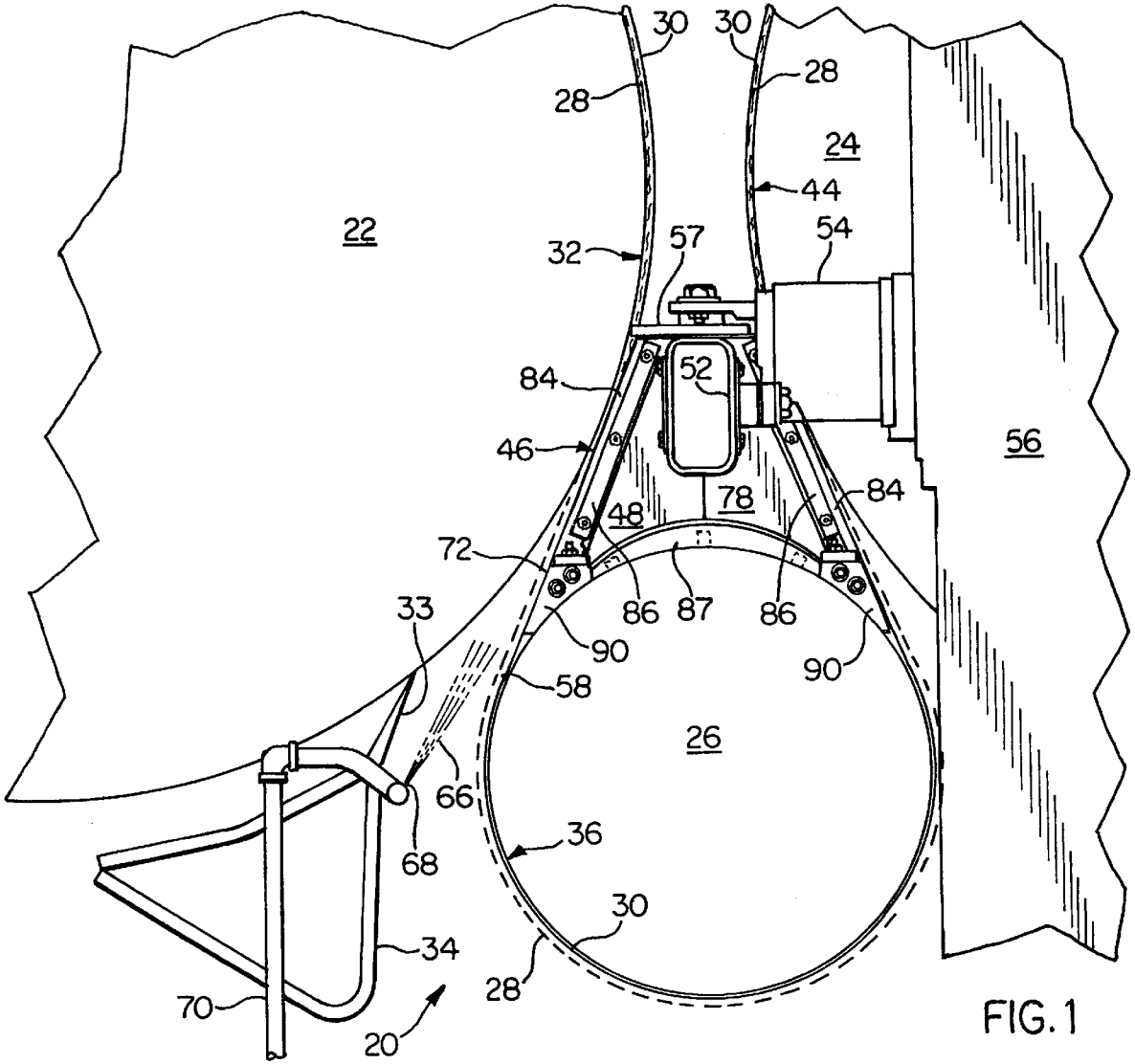
FIG. 1 is a front elevational view of the dryer threading apparatus of this invention.
Figure 2:
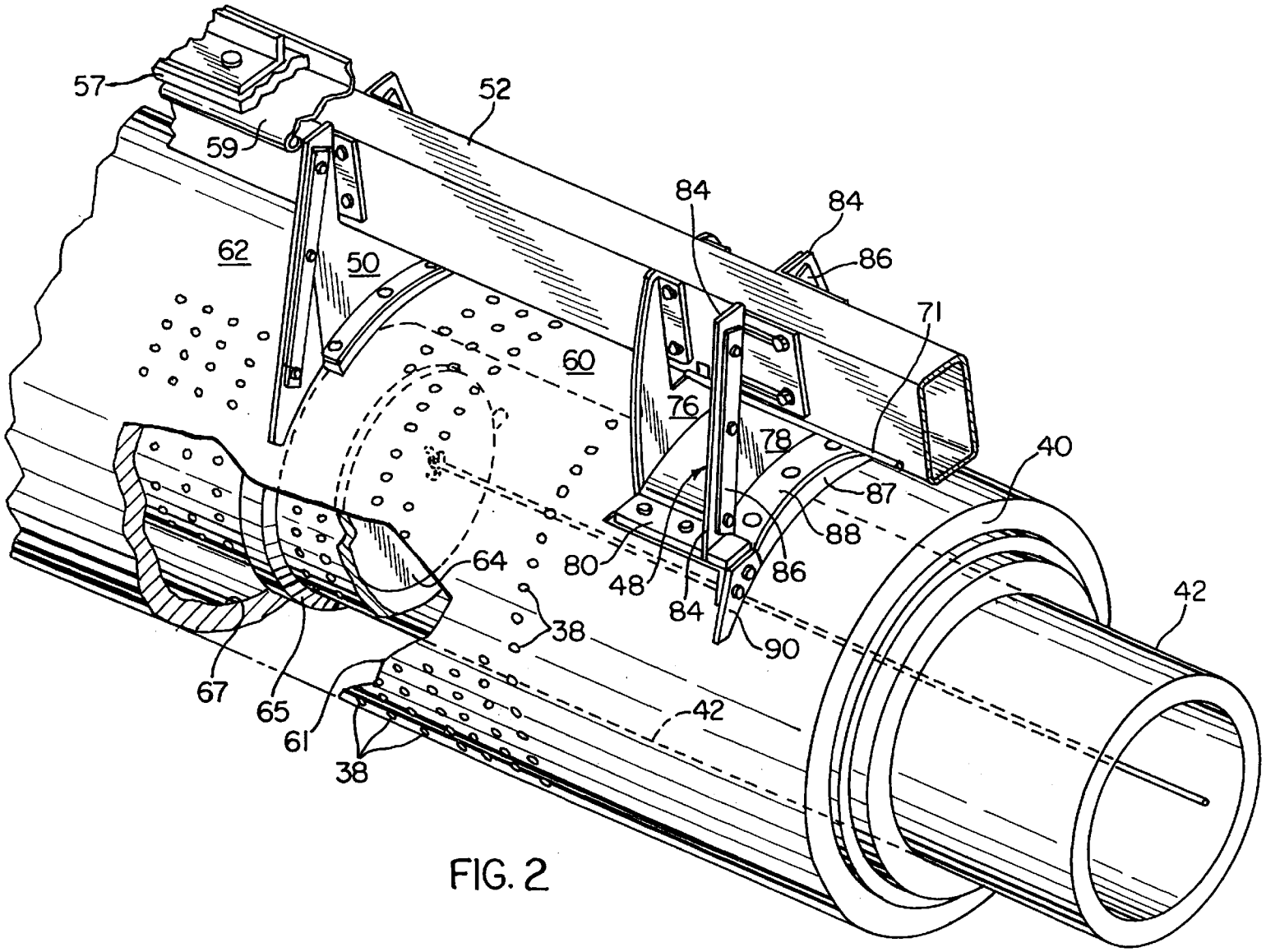
FIG. 2 is an isometric view, partially broken away, of the threading apparatus of FIG. 1 with the dryer rolls and the felt omitted for clarity.

Referring more particularly to FIGS. 1 and 2, wherein like numbers refer to similar parts, a portion of a top felted dryer section 20 is shown in FIGS. 1 and 2. The dryer section 20 has a first rotatable cylindrical heated dryer roll 22. A second dryer roll 24 is mounted for rotation downstream of the first dryer roll 22, and a reversing roll 26 is positioned between the first and second dryer rolls 22, 24. Typically, a dryer section will consist of a series of dryer rolls separated by reversing rolls. As shown in FIG. 1, a paper web 28 wraps around the first and second dryer rolls 22, 24 and is overlain by a dryer felt 30. In a preferred embodiment, the dryer felt has a permeability of between 70 and 500 cubic feet per minute per square foot at ½ inch of water pressure differential.

As the paper web 28 wraps around the dryer roll 22 it is held against the cylindrical heated surface 32 of the dryer roll 22. The dryer section 20 is a so-called single tier dryer also known by the Beloit Corporation trademark as a Bel-Run dryer. A single tier dryer is arranged with all the dryer rolls having their axes of rotation parallel and in a single plane or tier. The dryer section 20 is also a top felted dryer section inasmuch as the dryer felt 30 wraps over the top of the dryer rolls 22, 24. Single tier dryer sections achieve advantages in drying a paper web because the web comes into direct contact with each dryer and thus the dryer section uses fewer dryer rolls to achieve a given amount of drying. In addition, should the web 28 break, a doctor blade 33 mounted to a doctor back 34, as shown in FIG. 1, will remove the broke before it wraps around the dryer roll 22, thus greatly facilitating recovery from a paper break.

Because there is no lower tier of dryer rolls to transfer the web and dryer felt between, upper dryer reversing rolls 26 are positioned beneath and between adjacent dryer rolls 22, 24. The felt 30 is wrapped next to the reversing roll's surface 36 and the web 28 is wrapped outside the felt 30. As dryer speeds have increased it has become more important that the web be constrained throughout its travel through the dryer section if paper defects due to wrinkling or tearing of the web are to be avoided. In order to hold the web 28 on to the reversing roll 26, the reversing roll is a vacuum roll. Numerous holes 38 extend through the surface 36 of the vacuum roll and pierce the roll mantle 40, as shown in FIG. 2. For clarity, not all the holes have been shown in the figures. Vacuum is applied to the reversing roll 26 through a shaft 42. The reversing roll 26 is mounted on bearings for rotation. The shaft provides a means for extracting air from within the reversing roll and reducing the pressure therein.

The vacuum applied to the felt 30 as it moves around the reversing roll 26 allows atmospheric pressure to hold the web 28 against the felt 30. The reversing roll 26 performs the function of reversing the direction of the felt 30 and web 28 so that the web wraps onto the second dryer 24 with the web 28 against the surface 44 of the second dryer 24.

To assist in retaining the web in general, and the tail in particular, on the felt as it moves between the reversing rolls and the dryer rolls, a vacuum box 46 is positioned over each reversing roll 26 and between the first and second dryer rolls 22, 24. The vacuum boxes 46, which are positioned between each pair of dryer rolls, extend in the cross machine direction the full width of the reversing rolls and the dryer rolls. The vacuum boxes are constructed such that the sides of the box are defined not by rigid structure, but by the travelling felt itself. This approach allows the vacuum box to be conveniently divisible into distinct chambers in vacuum receiving communication with the reversing roll, to thereby associate differences in pressure within the reversing roll with differences in pressure within the vacuum box. A vacuum box 46 consists of a front end seal or baffle 48 and a back end seal or baffle (not shown) and an intermediate or threading seal or baffle 50, as shown in FIG. 2. The front, back and threading seals are mounted to a cross machine beam 52 which is mounted by a front machine bracket 54 to the dryer frame 56. In like manner, a back machine bracket (not shown) is mounted to the back dryer frame (not shown). The front and back seals, together with a top seal 57 which extends between and parallel to the dryer rolls 22, 24, form a sealed chamber with the reversing roll and the felt which forms the vacuum box 46. The top seal 57 is supported by a metal spring 59 which is fastened to the cross machine beam 52.

The vacuum box 46 has air drawn out of it through the foraminous surface of the reversing roll 26. The vacuum in turn pulls air through the felt as the felt 30 and web 28 travel between the first dryer roll 22 and the reversing roll 26, and from the reversing roll to the second dryer roll 24. By pulling air through the felt 30, the web is clamped by atmospheric pressure to the felt, thereby preventing fluttering as the paper web 28 leaves the dryer roll 22. The vacuum box 46 also prevents the boundary layer which is attached to the felt 30 and the reversing roll 26 from creating a region of high pressure where the felt and reversing roll meet along a line 58 shown in FIG. 1.

As shown in FIG. 2, the vacuum box 46 is divided into two sections by the threading seal 50: a threading section 60 defined between the front seal 48 and the threading seal 50, and the remaining non-threading portion 62. The fixed shaft 42 on which the reversing roll 26 is mounted carries vacuum to the roll 26. A seal 65 extends between the fixed shaft 42 and the interior surface of the roll 26. The seal 65 is positioned beneath the threading seal 50. The seal 65 is constructed of a nonmetallic lining material in touching or near touching engagement with the reversing roll 26. The seal 65 partitions the interior of the roll 26 into a threading section 61 and a non-threading section 67. A control damper baffle 64 is arranged to increase the vacuum applied to the threading section 61 of the reversing roll 26, and hence to the threading portion 60 of the vacuum box 46. The damper 64 is controllable to close off the non-threading portion 67 of the roll to increase the vacuum in the threading section 61. The damper baffle 64 may be formed with a hole in it or be modulated to have some vacuum in all parts of the reversing roll 26.

In a typical threading procedure, a tail four to twelve inches wide at the edge of the web 28 is separated from the web in the forming section (not shown), dewatered in the pressing section (not shown), and the remainder of the web is dumped to a broke pit and the tail alone is fed into the dryer section 20. The dryer felt positively engages the tail and directs the tail over the first dryer roll 22. As the felt 30 leaves the dryer roll 22 a jet of air 66 from one or more nozzles 68 supplied by an air pipe 70 blows the tail off the dryer roll surface 32 and onto a portion 72 of the felt 30. The web-receiving portion 72 of the felt 30 is supplied with heightened vacuum by the threading portion 60 of the vacuum box 46. The heightened vacuum, which can be measured through a measurement tube 71, shown in FIG. 2, is about two and one-half inches of water. The vacuum clamps the web 28 onto the felt 30 where it wraps around the reversing roll 26. The vacuum applied through the felt also assures that the tail completes the transition to the second dryer roll 24. Each additional dryer in the dryer section 20 is similarly threaded through the use of a damper baffle 64 in the reversing roll support shaft 42, to increase the vacuum drawn on a threading section of a vacuum box and a threading section of the reversing roll 26.

The design of the front seal 48, the back seal (not shown), the threading seal 50 and top seal 57 is important if the required level of vacuum needed for threading is to be maintained. The design of the front seal 48 as well as the back seal (not shown) must take into account the atmospheric loads which must be supported by the seal structure which is cantilevered from the support beam 52. If atmospheric loads deflect the front seal inwardly, the seal will rub and stub into the surface of the reversing roll 26.

Thus the front seal is composed of an inner sheet metal bracket 76 and an outer sheet metal bracket 78 which are bolted to the cross beam 52. The outer bracket 78 has side seals 84 which are bolted by straps 86 to the bracket 78. The side seals 84 are constructed of heavy cotton felt and are positioned to engage the felt 30 on either side of the seal 48 and are adjustable to the edge of the web 28. A reversing roll top seal 87 is riveted to a generally arcuate bottom flange 88 on the outer bracket 78. The roll top seal 87 is constructed of brake liner material and are aligned with the front roll seal 48. Two corner seals 90 are bolted to the outer bracket 78 and are constructed of a plastic material such as Teflon® material manufactured by Du Pont Co. The back seal (not shown) is similar in construction to the front seal 48. The threading seal 50 is also of similar construction with a bracket having heavy cotton side seals and a roll engaging lower brake liner material pad. Teflon corners pieces may be omitted from the threading seal 50.

The top seal 57 is constructed of a relatively thick pad approximately one-half to one inch thick of felted cotton. The felted cotton is supported on a leaf spring 59 which extends across the beam 52. Preferably, the felted cotton is supported on a plurality of leaf spring segments extending the length of the beam 52 in the cross machine direction. The leaf spring 59 extends in the machine direction between the first and second dryer rolls 22, 24. The leaf spring 59 is curled downwardly and inwardly to present a rounded surface which is spaced from the surfaces of the dryer rolls. The leaf spring serves to support the top seal felt against atmospheric pressure. The spaced end baffles or seal and the threading baffle or seal, thus define a region of reduced pressure which in a preferred embodiment is about thirty-five inches long in the cross machine direction. It is on this region that vacuum may be increased during the threading of the apparatus, and then reduced once the web has been successfully threaded.

It should be understood that although a pivoting damper has been illustrated for adjusting the level of vacuum within the reversing roll, other types of valves may also be employed.

It is understood that the invention is not limited to the particular construction and arrangement of parts herein illustrated and described, but embraces such modified forms thereof as come within the scope of the following claims.

I claim:

1. A dryer section having a single tier of dryer rolls with reversing rolls positioned between adjacent dryer rolls, the dryer section having a front end and a back end, and in receiving relation to a tail of a paper web of a width less than the full paper web, the dryer section comprising:

a plurality of dryer rolls forming an array of dryer rolls, each dryer roll having an axis and a cylindrical surface, wherein the axes of the dryer rolls are in substantially a single plane;

a plurality of reversing rolls, each reversing roll being positioned between adjacent dryer rolls, and each reversing roll having an axis, the axes of the reversing rolls lying in substantially a single plane which is spaced from and parallel to the plane containing the axes of the dryer rolls, wherein each reversing roll has a cylindrical surface which is closely spaced from the surface of adjacent dryer rolls;

a dryer felt wrapped around a portion of each dryer roll and each reversing roll and extending between the dryer rolls and the reversing rolls so as to hold a paper web tail against each dryer roll surface, wherein each reversing roll surface is foraminous and wherein each reversing roll has a means for drawing air through the roll foraminous surface;

a vacuum box positioned between adjacent dryer rolls in vacuum receiving relation to the reversing roll positioned between said adjacent dryer rolls, the vacuum box being defined by seals spaced in the cross machine direction and serving to apply vacuum to the web tail as the felt on which it moves progresses to a reversing roll from a dryer roll and to the adjacent dryer roll from the reversing roll;

an air jet positioned to blow on each dryer roll on a portion of the dryer roll surface adjacent to where the web and the dryer felt leave the surface of the dryer roll and travel to the closely spaced adjacent reversing roll;

a baffle dividing the vacuum box into a threading portion and a non-threading portion, the threading portion being positioned adjacent one end of the dryer section; and fixed shafts on which the reversing rolls are mounted for supplying vacuum to the roll;

a seal which extends between each fixed shaft and an interior surface of each roll, wherein each seal is positioned beneath the threading baffles and is constructed of a nonmetallic lining material in touching to near touching engagement with the reversing roll, the seal partitioning the interior of the roll into a threading section and a non-threading section;

a control damper baffle arranged to increase the vacuum applied to the threading section of the reversing roll and hence to the threading portion of the vacuum box the damper baffle being controllable to at least partially close off the non-threading portion of the roll to increase the vacuum in the threading section.

2. The dryer section of claim 1 wherein each reversing roll has portions defining a multiplicity of holes extending through the reversing roll surface.

3. The dryer section of claim 1 wherein the dryer felt has a permeability of between 70 and 500 cubic feet per minute per square foot at ½ inch of water pressure differential.

4. The dryer section of claim 1 wherein the vacuum box is formed of a front end baffle, a threading baffle, and a back end baffle supported on a cross machine beam, and a top baffle overlying the beam and extending between adjacent dryers, and wherein a region of reduced pressure is defined between the front end baffle and the threading baffle for selectively drawing air through the felt passing over the vacuum box adjacent said region, to thereby assist in retaining the web tail on the felt in threading the dryer section.

5. The dryer section of claim 4 wherein the top baffle is formed of a felted material in contact with the dryer felt and supported by a spring member.

6. The dryer section of claim 4 wherein each of the front baffle, the threading baffle, and the back baffle is comprised of a substantially triangular shaped bracket having an arcuate bottom positioned adjacent to the reversing roll and two sides extending between the top baffle and the reversing roll, and side felt seals are mounted to the sides which engage the dryer felt.

7. The dryer section of claim 6 further comprising a wearable liner positioned between the arcuate bottom and the reversing roll.

8. The dryer section of claim 6 wherein corners are defined between the linear side and the arcuate bottom of a baffle, and wherein Teflon inserts are mounted at said corners of said baffle to extend between the felt and the reversing roll as the felts extends between the dryer rolls and the reversing roll.

9. The dryer section of claim 1 wherein the dryer rolls are all top felted.

10. The dryer section of claim 9 further comprising doctor blades positioned against each dryer surface downstream of the air jets to prevent the web from wrapping around each dryer roll in the event the web is broken.

11. A threading apparatus in a papermaking machine single tier dryer section, the apparatus comprising:

a first dryer roll;

a second dryer roll;

a reversing roll positioned between the first dryer roll and the second dryer roll, wherein the reversing roll has an axis which is positioned below a first dryer roll axis and a second dryer roll axis;

a felt which is wrapped over a portion of the first dryer roll, beneath the reversing roll, and over a portion of the second dryer roll;

a web tail which is wrapped between the felt and the first dryer roll, wherein the web tail is narrower than the width of the reversing roll;

portions of the reversing roll which define a plurality of holes which communicate between the exterior and the interior of the reversing roll;

a fixed shaft on which the reversing roll is mounted for supplying vacuum to the roll;

a seal which extends between the fixed shaft and an interior surface of the roll the seal is constructed of a nonmetallic lining material in touching to near touching engagement with the reversing roll, the seal partitioning the interior of the roll into a threading section and a non-threading section;

a first baffle positioned above the reversing roll at one end of the reversing roll;

a second baffle spaced in the cross machine direction from the first baffle and positioned above the reversing roll at an end opposite the first baffle;

a threading baffle positioned between the first baffle and the second baffle to define a threading region between the threading baffle and the first baffle which corresponds approximately to the width of the web tail, and wherein a seal is defined between the first baffle and the threading baffle and the felt; and a control damper baffle arranged to increase the vacuum applied to the threading section of the reversing roll and hence to the threading portion of the vacuum box, wherein the damper is controllable to at least partially close off the non-threading portion of the roll to increase the level of air drawn from between the threading baffle and the first baffle where the web tail passes on the felt at the threading region, the increased level of air drawn at the threading region thereby creating a region of reduced pressure which draws air through the felt and thereby assists in retaining the web tail on the felt for threading across the reversing roll and onto the second dryer roll.

12. The threading apparatus of claim 11 wherein the means for adjustably increasing the level of air drawn is a damper positioned within the reversing roll, and wherein the damper is positioned approximately below the threading baffle.

13. The threading apparatus of claim 11 wherein the first baffle, the threading baffle and the second baffle are connected to a fixed cross machine beam which is positioned above the reversing roll.

14. The threading apparatus of claim 13 wherein the baffles are adjustably fixed to the cross machine beam for selected placement to correspond to sheet width and roll seal placement.

15. The threading apparatus of claim 13 wherein the first baffle comprises a first bracket connected to the cross machine beam, and having a lower arcuate bottom which is positioned above the reversing roll.

16. A threading apparatus in a papermaking machine single tier driver section, the apparatus comprising:

a first dryer roll;

a second dryer roll;

a reversing roll positioned between the first dryer roll and the second dryer roll, wherein the reversing roll has an axis which is positioned below a first dryer roll axis and a second dryer roll axis;

a felt which is wrapped over a portion of the first dryer roll, beneath the reversing roll, and over a portion of the second dryer roll;

a web tail which is wrapped between the felt and the first dryer roll, wherein the web tail is narrower than the width of the reversing roll;

portions of the reversing roll which define a plurality of holes which communicate between the exterior and the interior of the reversing roll;

means for drawing air from the interior of the reversing roll, and thereby drawing air through the reversing roll holes;

a first baffle positioned above the reversing roll at one end of the reversing roll;

a second baffled spaced in the cross machine direction from the first baffle and positioned above the reversing roll at an end opposite the first baffle;

a threading baffle positioned between the first baffle and the second baffle to define a threading region between the threading baffle and the first baffle which corresponds approximately to the width of the web tail, and wherein a seal is defined between the first baffle and the threading baffle and the felt; and a means for adjustably increasing the level of air drawn from between the threading baffle and the first baffle where the web tail passes on the felt at the threading region, the increased level of air drawn at the threading region thereby creating a region of reduced pressure which draws air through the felt and thereby assists in retaining the web tail on the felt for threading across the reversing roll and onto the second dryer roll, wherein the means for adjustably increasing the level of air drawn is a damper positioned within the reversing roll, wherein the damper is positioned approximately below the threading baffle, wherein the first baffle comprises a first bracket connected to the cross machine beam, and having a lower arcuate bottom which is positioned above the reversing roll, and wherein the first baffle further comprises a second bracket positioned between the first bracket and the threading baffle, and wherein a portion of brake lining material is affixed beneath the connected first and second brackets to define a rotating seal between the first baffle and the reversing roll.

17. The threading apparatus of claim 11 further comprising an air jet positioned to blow on the first dryer roll where the web tail and the dryer felt leave the first dryer roll and travel to the reversing roll.

18. The threading apparatus of claim 13 wherein the second baffle comprises:

a bracket connected to the cross machine beam and adjustable for sheet width;

a first strip of fibrous material connected to the bracket to engage the felt as it extends from the first dryer roll to the reversing roll and to form a seal therewith;

a second strip of fibrous material connected to the bracket to engage the felt as it extends from the reversing roll to the second dryer roll and to form a seal therewith; and a third strip of fibrous material connected beneath the bracket to engage the rotating reversing roll and form a seal therewith.

19. The threading apparatus of claim 13 wherein the seal between the baffles and the felt is further defined by a strip of fibrous material positioned on the cross machine beam and urged against the felt by at least one spring.

* * * * *